US010836168B2

(12) United States Patent
Kasai et al.

(10) Patent No.: US 10,836,168 B2
(45) Date of Patent: Nov. 17, 2020

(54) LIQUID EJECTION HEAD AND METHOD OF MANUFACTURING THE SAME

(71) Applicant: CANON KABUSHIKI KAISHA, Tokyo (JP)

(72) Inventors: Ryo Kasai, Tokyo (JP); Takashi Sugawara, Yokohama (JP); Masafumi Morisue, Tokyo (JP); Takuro Yamazaki, Inagi (JP); Yoshiyuki Nakagawa, Kawasaki (JP); Kazuhiro Yamada, Yokohama (JP); Tomoko Kudo, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/136,563

(22) Filed: Sep. 20, 2018

(65) Prior Publication Data

US 2019/0092019 A1 Mar. 28, 2019

(30) Foreign Application Priority Data

Sep. 27, 2017 (JP) ..... 2017-186671

(51) Int. Cl.
*B41J 2/16* (2006.01)
*B41J 2/165* (2006.01)
*B41J 2/14* (2006.01)

(52) U.S. Cl.
CPC ..... *B41J 2/162* (2013.01); *B41J 2/1433* (2013.01); *B41J 2/14129* (2013.01); *B41J 2/165* (2013.01); *B41J 2/1609* (2013.01); *B41J 2002/14467* (2013.01); *B41J 2202/03* (2013.01); *B41J 2202/10* (2013.01); *B41J 2202/11* (2013.01); *B41J 2202/13* (2013.01)

(58) Field of Classification Search
CPC .... B41J 2/14129; B41J 2202/03; B41J 2/164; B41J 2/1433; B41J 2/162; B41J 2002/14491
See application file for complete search history.

(56) References Cited

U.S. PATENT DOCUMENTS

2015/0109371 A1* 4/2015 Ishida ..... B41J 2/1404 347/56
2018/0154635 A1* 6/2018 Nakakubo ..... B41J 2/1623

FOREIGN PATENT DOCUMENTS

WO 2013/130039 A1 9/2013

OTHER PUBLICATIONS

U.S. Appl. No. 16/136,550, filed Sep. 20, 2018, Kudo et al.

* cited by examiner

*Primary Examiner* — Jannelle M Lebron
(74) *Attorney, Agent, or Firm* — Venable LLP

(57) ABSTRACT

A liquid ejection head is manufactured by forming on a substrate an energy generating element for ejecting a liquid, an integrated circuit for driving the energy generating element, a supply port for the liquid so as to penetrate through the substrate, an electrode for generating a liquid flow, and a flow path forming member having an ejection orifice for ejecting the liquid such that a flow path for the liquid is formed between the substrate and the flow path forming member. The electrode is formed over high and low of a stepped shape formed on the substrate in at least one step selected from the steps of forming the energy generating element, forming the integrated circuit and forming the supply port.

17 Claims, 5 Drawing Sheets

LIQUID EJECTION HEAD AND METHOD OF MANUFACTURING THE SAME

BACKGROUND OF THE INVENTION

Field of the Invention

The present invention relates to a liquid ejection head and a method of manufacturing the same.

Description of the Related Art

In a liquid ejection head that ejects a liquid such as ink, the liquid in a flow path to an ejection orifice that ejects the liquid often thickens due to evaporation from the ejection orifice of a volatile component in the liquid. In this case, ejection speed of liquid droplets may change, or failure in ejection of liquid droplets may be caused. As a countermeasure to solve such liquid thickening phenomenon as mentioned above, a method of flowing a fresh liquid, that has not thickened, in the flow path to the ejection orifice is known. For flowing such a fresh liquid in a flow path, a method of using a micro-pumping phenomenon such as alternating-current electro-osmotic flow (ACEO) is known (International Publication No. WO2013/130039).

SUMMARY OF THE INVENTION

The method of manufacturing a liquid ejection head of the present invention includes steps of:

forming an energy generating element for ejecting a liquid on a substrate;

forming an integrated circuit for driving the energy generating element on the substrate;

forming a supply port for the liquid such that the supply port penetrates through the substrate;

forming an electrode for generating a flow of the liquid; and forming a flow path forming member having an ejection orifice for ejecting the liquid such that a flow path for the liquid is formed between the substrate and the flow path forming member, wherein the electrode is formed over high and low of a stepped shape on the substrate in the step of forming the electrode, the stepped shape being formed in at least one step selected from the group consisting of the steps of forming the energy generating element, forming the integrated circuit, and forming the supply port.

A liquid ejection head of the present invention includes a substrate, an energy generating element provided on the substrate for ejecting a liquid, an integrated circuit provided on the substrate for driving the energy generating element, a flow path forming member which has an ejection orifice for ejecting the liquid and is provided such that a flow path for the liquid is formed between the substrate and the flow path forming member, and an electrode for generating a flow of the liquid in the flow path, wherein the electrode is formed over high and low of a stepped shape formed by the integrated circuit on the substrate.

Further features of the present invention will become apparent from the following description of exemplary embodiments with reference to the attached drawings.

DESCRIPTION OF THE EMBODIMENTS

Figure 1A:
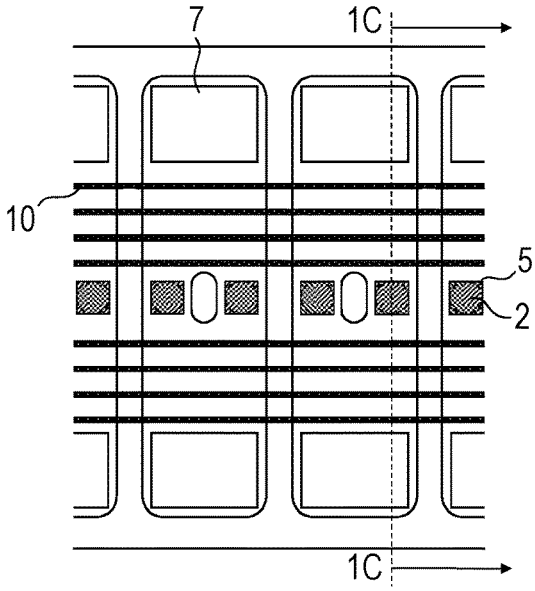
FIGS. 1A, 1B, 1C and 1D are schematic plan and cross sectional views of a liquid ejection head according to an embodiment of the present invention.

Preferred embodiments of the present invention will now be described in detail in accordance with the accompanying drawings.

In a method utilizing a micro-pump function as described in the International Publication No. WO2013/130039, liquid circulation (liquid transfer) efficiency is improved by providing a stepped shape to the electrode for generating a liquid flow. As a result, the reliability of liquid ejection can be improved.

However, in this method, since a step of forming a member for providing a stepped shape to the electrode is performed separately, the manufacturing cost of the liquid ejection head is increased.

In contrast, the method of manufacturing a liquid ejection head of the present invention does not need a separate step of forming a member for providing a stepped shape to an electrode for generating a liquid flow, hence capable of providing a liquid ejection head at low cost.

The method of manufacturing a liquid ejection head of the present invention includes steps of: forming an energy generating element for ejecting a liquid (hereinafter referred to as "the step of forming the energy generating element") on a substrate; forming an integrated circuit for driving the energy generating element (hereinafter referred to as "the step of forming the integrated circuit") on the substrate; forming a supply port for the liquid (hereinafter referred to as "the step of forming a supply port") such that the supply port penetrates through the substrate; forming an electrode for generating a liquid flow (hereinafter referred to as "the step of forming the electrode)"; and forming a flow path forming member having an ejection orifice for ejecting the liquid (hereinafter referred as "the step of forming the flow path forming member") such that a flow path for the liquid is formed between the substrate and the flow path forming member, wherein, in the step of forming the electrode, the electrode is formed over high and low of a stepped shape on the substrate, the stepped shape being formed in at least one step selected from the group consisting of the step of forming the energy generating element, the step of forming the integrated circuit and the step forming the supply port.

In the method of the present invention, the electrode is formed over high and low of a stepped shape on the substrate. The stepped shape is formed in at least one step selected from the group consisting of the step of forming the energy generating element, the step of forming the integrated circuit and the step of forming the supply port. Since the electrode is formed by utilizing a stepped shape which is formed in a step to be performed necessarily for manufacturing a liquid ejection head, the manufacturing cost can be reduced.

The liquid ejection head according to the present invention includes a substrate, an energy generating element, an integrated circuit, a flow path forming member and an electrode. The energy generating element is formed on the substrate and utilized for ejecting a liquid. The integrated circuit is formed on the substrate to drive the energy generating element. The flow path forming member has an ejection orifice for ejecting the liquid and forms a flow path for the liquid between the substrate and the flow path forming member. The electrode generates a flow of the liquid and is formed over high and low of a stepped shape formed by the integrated circuit on the substrate.

The electrode in the liquid ejection head according to the present invention is formed by utilizing a stepped shape formed by the integrated circuit on the substrate. Therefore, in the liquid ejection head of the present invention, a special member for providing a stepped shape to the electrode is not used. Therefore, in the above method of manufacturing a liquid ejection head, it is not required to separately form an additional member utilized for forming a stepped shape, and hence a liquid ejection head of the present invention can be manufactured with low cost.

Now, the liquid ejection head according to an embodiments of the present invention is described with reference to the attached drawings. Explained specifically in each of the embodiments in the below are a number of structures for an inkjet recording head from which ink as a liquid is ejected. An inkjet recording head mentioned as one embodiment of the present invention can be used for an apparatus such as a printer, a copying machine, a facsimile machine having a communication system, a word processor having a printer unit and the like and an industrial recording apparatus incorporated into various processing apparatuses. However, the present invention is not limited to a liquid ejection head using ink as a liquid. The liquid ejection head of the present invention may be used in performing, for example, biochip fabrication and electronic circuit printing.

First Embodiment

Figure 1B:
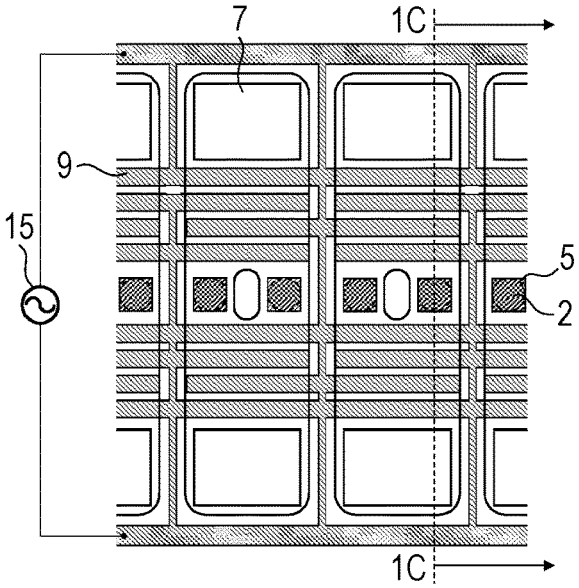
Figure 1C:
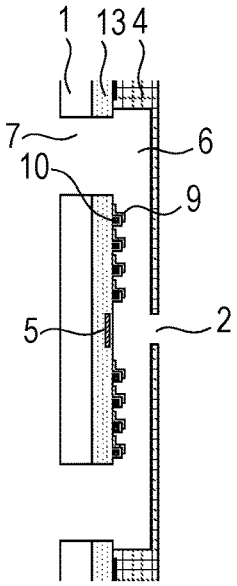
Figure 1D:
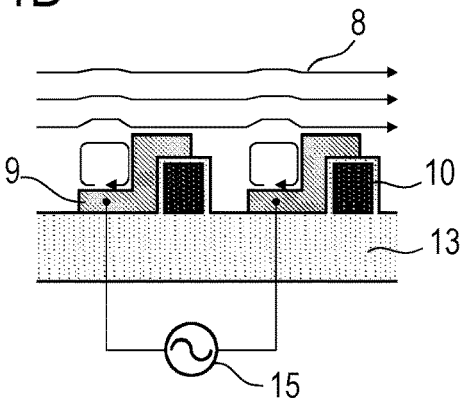

FIGS. 1A and 1B are schematic plan views of an inkjet recording head according to a first embodiment of the present invention. FIG. 1C is a schematic cross-sectional view taken along line 1C-1C in FIGS. 1A and 1B. FIG. 1D is an enlarged schematic cross-sectional view of an electrode portion in FIG. 1C for illustrating a flow of ink generated by alternating-current electro-osmotic flow. While electrodes 9 are actually provided in this embodiment, the electrodes 9 are not shown in FIG. 1A in order to facilitate the understanding of the structure. The electrodes 9 are shown in FIG. 1B on the other hand.

Arranged on a substrate 1 are energy generating elements 5 and an integrated circuit including transistors (not shown) for driving the energy generating elements 5, wiring lines 10 and an insulating film 13, etc. The substrate 1 may be made of silicon. The wiring lines 10 may be power lines or signal lines of the integrated circuit. The wiring lines 10 may comprise Al, Cu, W, Ta, Ir, Au, compounds thereof, polysilicon, etc. The wiring lines 10 may comprise one thereof or two or more thereof. In this embodiment, the wiring lines 10 are made of Al. The wiring lines 10 in this embodiment constitute an uppermost wiring layer, and therefore the insulating film 13 formed on the wiring lines 10 is not flattened by CMP or like others. The insulating film 13 may be a passivation film, an SiO film, a BPSG (Boro-Phospho Silicate Glass) film, an SOG (Spin On Glass) film or a field oxide film. The insulating film 13 in this embodiment is a passivation film formed of a SiN film or like others. The energy generating elements 5 and the integrated circuit can be formed by a common semiconductor process.

The electrodes 9 for generating a flow of ink are formed over high and low of a stepped shape formed by the wiring lines 10 on the substrate 1. The electrodes 9 may be composed of a metal material such as Au, Pt, Ta, Ir, Ti, W, compounds thereof, etc. The electrodes 9 are connected to an AC power source 15 which supplies an electric power required for generating a flow of ink from the AC power source 15 to the electrodes 9. The electrodes 9 are formed according to the following steps. For example, after forming a layer to become the electrodes 9 over the whole surface of the substrate 1, a resist is applied onto the layer. Then, after removing the resist on areas other than the portions for forming the electrodes 9, the electrodes are is formed over high and low of a stepped shape on the substrate 1 by pattering the layer by means of wet etching.

In the substrate 1, supply ports 7 for ink are formed such that each of them penetrates through the substrate 1 and communicates with a flow path 6. The supply ports 7 can be formed by performing dry etching from the surface of the substrate 1 on the side on which the insulating film 13 is formed. The supply port 7 may be formed to penetrate through the substrate 1 by performing dry etching also from the side opposite to the side on which the insulating film 13 is formed.

On the substrate 1 is formed a flow path forming member 4 having ejection orifices 2 for ejecting ink such that flow paths 6 for the ink are formed between the substrate 1 and the flow path forming member 4. Ink supplied into the flow paths 6 from the supply ports 7 is ejected from the ejection orifices 2 by an energy generated by the energy generating elements 5 to a recording medium onto which recording is performed. The area between each energy generating element 5 and the corresponding ejection orifice 2 functions as a pressure chamber. Each pressure chamber communicates with a corresponding flow path 6 and an energy generating element 5 is provided in the pressure chamber. The flow path forming member 4 can be formed, for example, by the following steps. The flow path forming member 4 is formed by laminating a photosensitive resin film to the substrate 1 and the insulating film 13, followed by exposure and development, and by repeating these steps.

The electrodes 9 generate a flow of ink flow by alternating-current electro-osmotic flow to circulate the ink in the flow paths 6. As shown in FIGS. 1B and 1C, the electrodes 9 are formed in a comb-tooth shape between the supply ports 7 and the energy generating elements 5 on the substrate, and an AC voltage is applied between adjacent two of the electrodes 9. When a voltage difference occurs between the adjacent electrodes 9, the ink in contact with the electrodes 9 is electrically charged, and an electric double layer is formed on the surface of the electrodes 9. Therefore, Coulomb force is applied to the charged ink on the surface of the electrodes 9 by an electric field generated between the electrodes 9. As a result, as shown in FIG. 1D, a flow of ink is caused in the direction indicated by arrows 8. Consequently, circulation of the ink in the pressure chamber through an outside of the pressure chamber occurs by means of the electrodes 9. Since each of the electrodes 9 of this embodiment is formed over high and low of the stepped shape, the Coulomb force is generated in the opposite directions between the higher portion and the lower portion (the right half and the left half of each electrode 9 in FIG. 1D) in the ink on the surface of each electrode 9. However, as shown in FIG. 1D, since a vortex flow is generated on the lower portion of the stepped shape, flows of ink do not collide with each other in the flow paths 6, but ink flows in one direction as indicated by the arrows 8. As explained above, it is possible to form a micro-pump having a higher liquid transfer efficiency by providing a stepped shape to the electrodes 9.

In the method of manufacturing an inkjet recording head according to this embodiment, the electrodes 9 are formed over high and low of a stepped shape formed in the step of forming the integrated circuit. Specifically, the electrodes 9 are formed by utilizing stepped shapes of wiring lines 10 formed in the integrated circuit forming step. Therefore, since it is not required to separately perform an additional step for forming a stepped shape for the electrodes 9, an inkjet recording head with a high performance micro-pump can be manufactured at low cost.

In this embodiment, the electrodes 9 are formed by utilizing stepped shapes of the wiring lines 10. However, electrodes 9 may be formed by utilizing not only stepped shapes of the wiring lines 10, but any other stepped shapes formed in the step of forming an integrated circuit can be utilized. For example, it is possible to use a stepped shape formed in opening the insulating film 13 formed on the substrate 1. For example, it is possible to use a stepped shape formed in opening a field oxide film for forming a transistor. Further, it is possible to use a stepped shape formed in forming a through hole for connecting wiring lines 10 or for connecting a wiring line 10 and the substrate 1.

Second Embodiment

Figure 2:
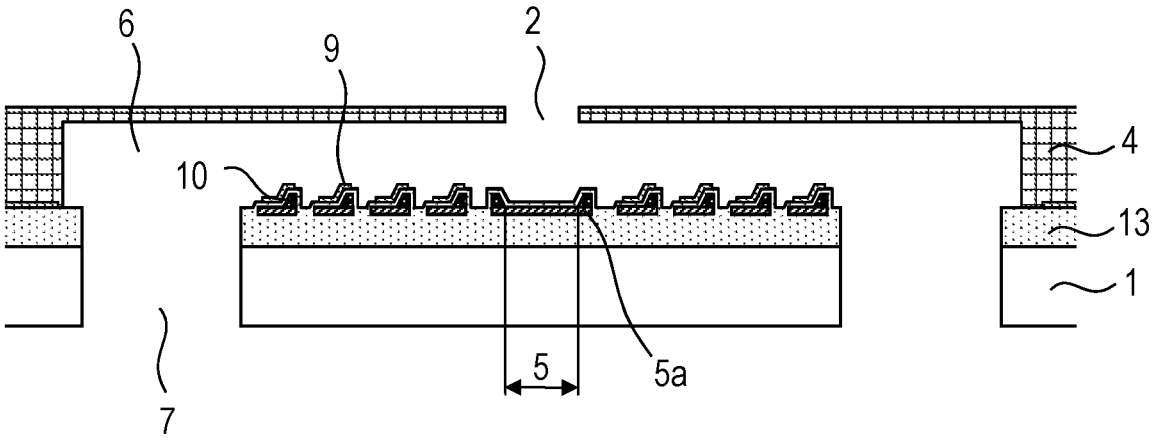
FIG. 2 is a schematic cross sectional view of a liquid ejection head according to another embodiment of the present invention.

FIG. 2 is a schematic cross sectional view of an inkjet recording head according to a second embodiment of the present invention. In this embodiment, each structure of the energy generating elements 5 and the wiring lines 10 is different from that in the first embodiment in that both the ends of each energy generating element 5 and each wiring line 10 having a stepped shape are tapered. In the method of manufacturing an inkjet recording head according to this embodiment, the electrodes 9 are formed by utilizing stepped shapes formed in the step of forming the energy generating elements 5. Therefore, as in the first embodiment, since it is not required to separately perform an additional step for forming a stepped shape for each electrode 9, an inkjet recording head with a high performance micro-pump can be manufactured at low cost.

The inkjet recording head according to this embodiment can be manufactured by, for example, the method mentioned below. A laminated film comprised of an energy generating element film 5*a* and a film made of Al or like others which is to form wiring lines is formed on the substrate 1 on which an insulating film 13 is formed. Next, wiring lines 10 are patterned at a time by dry etching. After that, a resist is applied onto the laminated film, then an opening is formed only on portions for forming the energy generating elements 5, and only the film layer to form the wiring lines 10 of the laminated film is removed by wet etching. In this step, etching can proceed in a direction parallel to the substrate 1 by gradually peeling off the end portions of each resist opening from a film layer to form a wiring line 10, and the wiring line 10 is tapered on both the ends of each energy generating element 5. By providing tapers as mentioned above, current concentration is mitigated in the interface between the energy generating elements 5 and the wiring lines 10, and occurrence of disconnection is suppressed. Further, covering property of the insulating film 13 on the energy generating elements 5 is improved, and insulation reliability is improved. After that, in the same manner as in the first embodiment, the electrodes 9 are formed over high and low of stepped shapes formed by the wiring lines 10, while supply ports 7 and a flow path forming member 4 are formed.

In this embodiment, as in the first embodiment, while each of the electrodes 9 is formed with a stepped shape formed by utilizing a stepped shape formed by a wiring line 10, the stepped shape is formed at the same time as in forming the energy generating elements 5. Therefore, the stepped portions of the electrodes 9 can be also tapered. Since the stepped shapes are tapered, the electrodes 9 are easily patterned and short-circuiting between the electrodes 9 caused by etching failure is prevented. In the same manner as for the energy generating elements 5, since covering property of the insulating film 13 on the wiring lines 10 is improved, insulation reliability between the wiring lines 10 and the electrodes 9 is secured. As mentioned above, by forming the electrodes 9 by utilizing the stepped shapes in forming the energy generating elements 5, a liquid ejection head, in which a micro-pump is provided, and which has a higher electrical reliability can be manufactured.

Third Embodiment

Figure 3A:
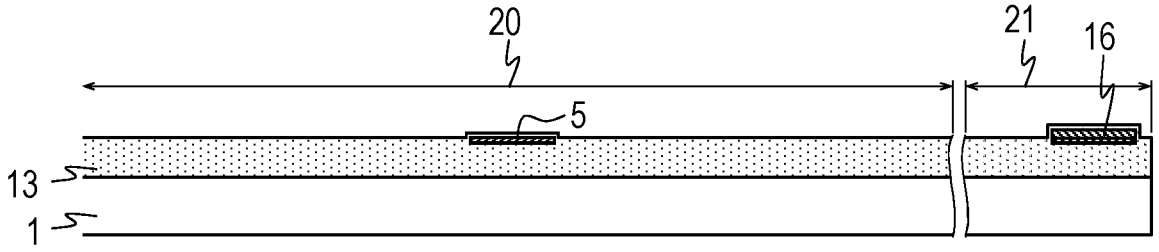
FIGS. 3A, 3B and 3C are schematic cross-sectional views for illustrating a method of manufacturing a liquid ejection head according to an embodiment of the present invention.
Figure 3B:
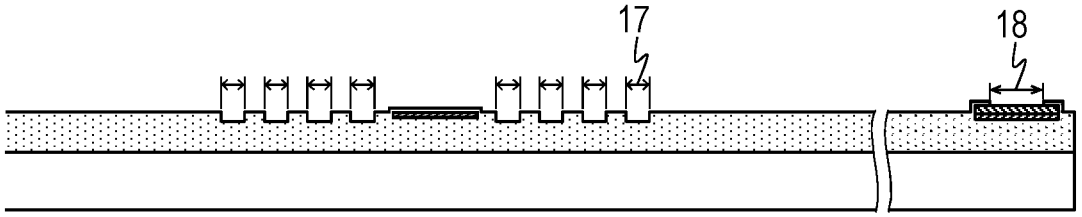
Figure 3C:
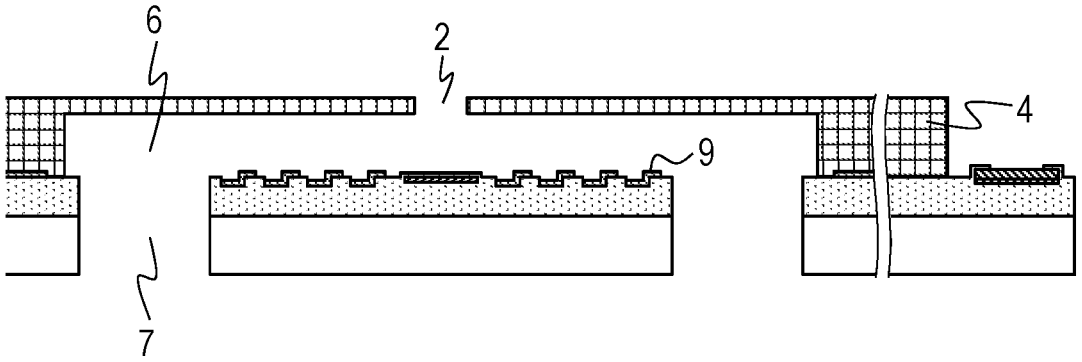

FIGS. 3A to 3C are schematic cross-sectional views for illustrating the respective steps in a method of manufacturing a liquid ejection head according to a third embodiment of the present invention. In this embodiment, as shown FIG. 3C, by utilizing stepped shapes formed by the hollows 17 of an insulating film 13, electrodes 9 are formed over high and low of stepped shapes. The hollows 17 of the insulating film 13 that form the stepped shapes are formed at a time when openings in the insulating film 13 are formed on the PAD electrodes 16 that are arranged on the substrate 1. Therefore, in the same manner as in the first and second embodiments, it is not required to perform an additional step, separately from other steps for forming stepped shapes for the electrodes 9, and hence a high performance inkjet recording head, in which a micro-pump is provided, can be manufactured.

The inkjet recording head of this embodiment can be manufactured by, for example, the method as mentioned below. As shown in FIG. 3A, transistors (not shown), wiring lines (not shown), energy generating elements 5, an insulating film 13 as a passivation film, and PAD electrodes 16 are formed on a substrate 1. The energy generating elements 5 are arranged in each area 20 around an ejection orifice, and the PAD electrodes 16 are arranged in a PAD area 21 on the substrate 1 which does not contact with flow paths 6.

Next, as shown in FIG. 3B, the insulating film 13 on the PAD electrodes 16 is opened by dry etching to provide PAD openings 18. In performing this dry etching, not only the openings in the insulating film 13 on the PAD electrodes 16 but also hollows 17 are formed in the surface of the insulating film 13 in the areas 20 around the ejection orifices. At this time, since the hollows 17 have no etch stop layer, the depth of the hollows 17 is determined according to the etching time. In the openings of the insulating film 13 on the PAD electrodes, on the other hand, the PAD electrodes 16 function as an etch stop layer. Since over etching is performed for ensuring formation of the PAD openings 18 as exposing the PAD electrodes, the hollows 17 are formed deeper than the PAD openings 18. After that, as shown in FIG. 3C, the electrodes 9 are formed over high and low of the stepped shapes of the hollows 17, and further, supply ports 7 and a flow path forming member 4 are formed.

In this embodiment, the hollows 17 are formed at a time when the openings on the PAD electrodes 16 are formed in the insulating film 13, and the stepped shapes of the electrodes 9 are formed by utilizing the stepped shapes of the hollows 17. However, stepped shapes formed in forming the supply ports 7 may alternatively be utilized. For example, the hollows 17 are formed in the surface of the insulating film 13 at a time in the step of forming the supply ports 7 by forming openings through the substrate 1 by dry etching. The stepped shapes of the electrodes 9 may be formed by utilizing these hollows 17.

Forth Embodiment

Figure 4A:
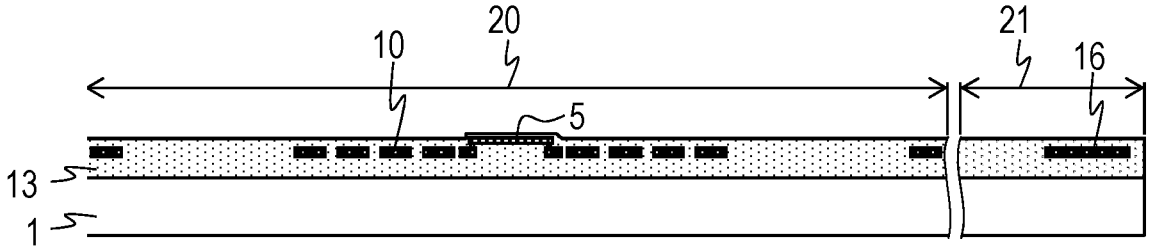
FIGS. 4A, 4B and 4C are schematic cross-sectional views for illustrating a method of manufacturing a liquid ejection head according to another embodiment of the present invention.
Figure 4B:
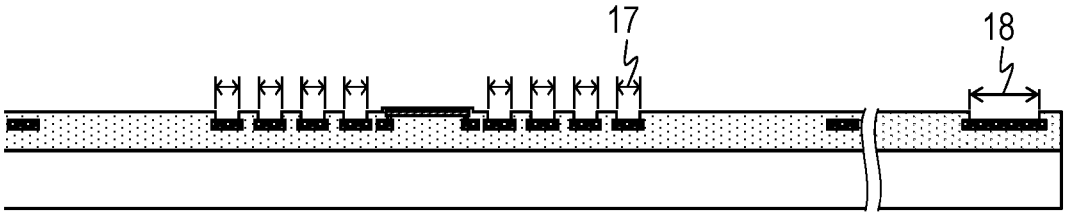
Figure 4C:
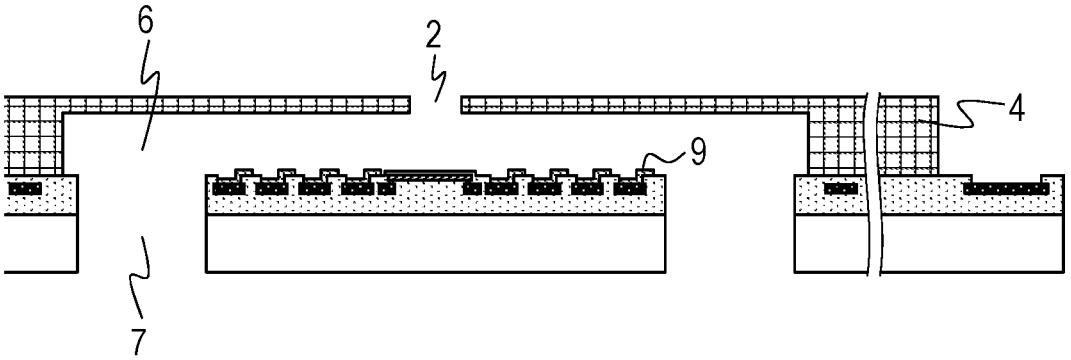
Figure 5A:
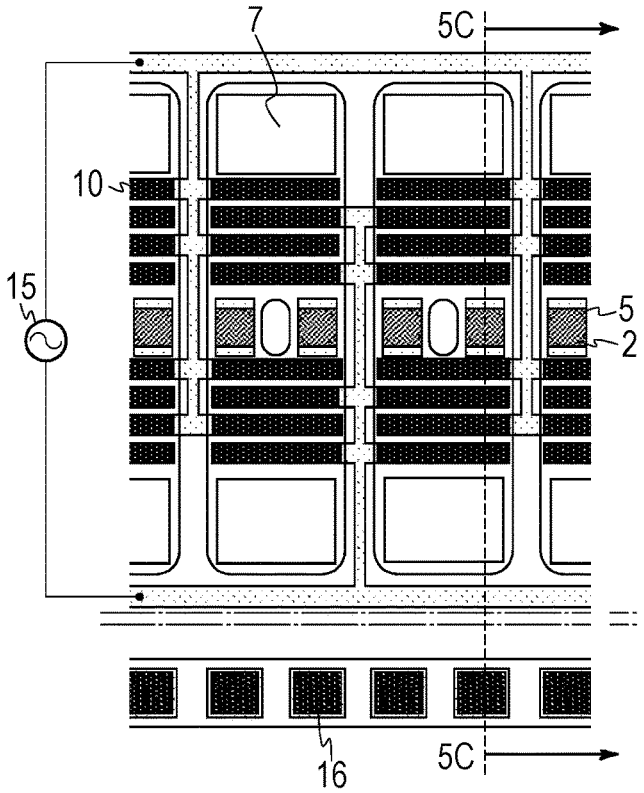
FIGS. 5A, 5B and 5C are schematic plan and cross-sectional views a liquid ejection head manufactured by the method illustrated in FIGS. 4A to 4C according to an embodiment of the present invention.
Figure 5B:
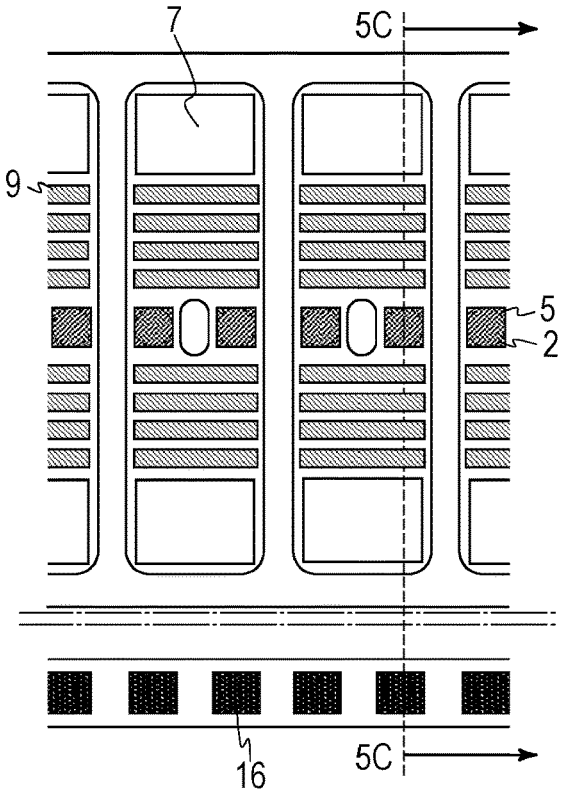
Figure 5C:
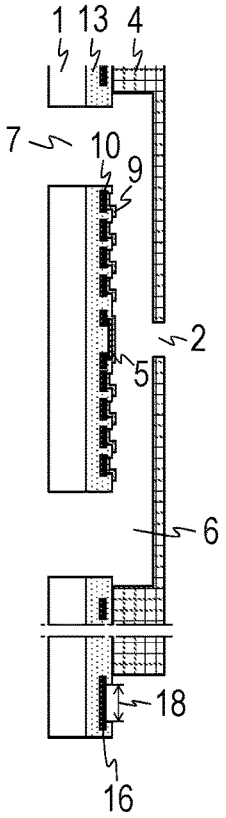

FIGS. 4A to 4C are schematic cross-sectional views for illustrating each of the steps in manufacturing an inkjet recording head according to a fourth embodiment of the present invention. FIGS. 5A to 5C are schematic plan and cross-sectional views for illustrating an inkjet recording head according to this embodiment. Note that, in this embodiment, electrodes 9 are actually provided. However, in FIG. 5A, the electrodes 9 are not shown in order to facilitate understanding of the structure, while the electrodes are shown in FIG. 5B. In this embodiment, as shown FIG. 4C, in the same manner as in the third embodiment, the electrodes 9 are formed over high and low of stepped shapes formed by hollows 17 in the insulating film 13. In this structure, wiring lines 10 are arranged on the bottom surface of the hollows 17, and the electrodes 9 are in contact with the wiring lines 10. Further, as shown in FIGS. 5A to 5C, an electric power for generating a flow of ink is applied to the electrodes 9 through the wiring lines 10 from an AC power source 15. In the first embodiment, as shown in FIG. 1B, the AC power source 15 is directly connected to the electrodes 9 through the wiring lines 10. However, in this embodiment, the AC power source 15 is connected to the electrodes 9 through the wiring lines 10. When a material having a high resistivity is used for the electrodes, in the structure in the first embodiment, since voltage drop occurs by consumption current of the electrodes 9, a desired AC voltage may not be applied to the electrode 9 in some cases. On the other hand, in the structure in this embodiment, since the wiring lines 10 made of Al or like others having low resistance is formed, voltage drop can be minimized. Thereby, a desired AC voltage can be applied to the electrodes 9.

Further, in this embodiment, hollows 17 forming the stepped shapes are etched at a time when openings are formed in the insulating film 13 on the PAD electrodes 16 by using the wiring lines 10 as an etch stop layer. By performing etching using the wiring lines 10 as an etch stop layer, the depth of the hollows 17 can be controlled with high precision.

The inkjet recording head according to this embodiment can be manufactured by, for example, the method mentioned as follows. First, as shown in FIG. 4A, transistors (not shown), wiring lines 10, energy generating elements 5, an insulating film 13 and PAD electrodes 16 are formed on the substrate 1. In this embodiment, wiring lines 10 mode of Al or the like are formed at positions where hollows 17 are to be formed in the insulating film 13. Further, the PAD electrodes 16 are formed in the same step as forming the wiring lines 10. That is, the wiring lines 10 are formed in the same layer as the PAD electrodes 16. The PAD electrodes 16 are formed at a level deeper than the energy generating elements 5 in the insulating film 13.

Next, as shown FIG. 4B, openings are formed in the insulating film 13 on the PAD electrodes 16 by dry etching to form PAD openings 18, and at the same time when performing this dry etching, hollows 17 are formed in the insulating film 13 on the wiring lines 10. As in the third embodiment, while dry etching is performed also in this fourth embodiment, since the wiring lines 10 arranged in the insulating film function as an etch stop layer, the depth of the hollows 17 can be controlled with high accuracy. For example, by arranging the wiring lines 10 at a deeper level in the insulating film 13, deeper hollows 17 can be formed with high accuracy, and the electrodes 9 each having a stepped shape with a larger difference in height can be formed with high accuracy. Further, in this embodiment, since the wiring lines 10 are in the same layer as the PAD electrodes 16 and they are hence positioned at the same depth level in the insulating film 13, it is possible to suppress excessive over-etching of both of them. After that, as shown in FIG. 4C, the electrodes 9 are formed over high and low of the respective stepped shapes at the hollows 17 and on the wiring lines 10 so as to contact with them, along with the supply ports 7 and the flow path forming member 4.

In this embodiment, the electrodes 9 can be made of a metal, and the flow path forming member 4 can be made of a resin. In this case, when the electrodes 9 above the substrate 1 come into contact with the flow path forming member 4, since adhesion strength between a resin and a metal is low, there is a possibility that the flow path forming member 4 peels off from the substrate 1 by the stress due to a difference in linear thermal expansion coefficient. However, in this embodiment, as shown in FIGS. 4C and 5C, since electrodes 9 are arranged on the substrate 1 between a supply port 7 and an energy generating element 5, the electrodes 9 and the flow path forming member 4 do not contact with each other. Accordingly, in this embodiment, adhesion between the flow path forming member 4 and the substrate 1 is ensured.

As mentioned above, in the structure of this embodiment, the electrodes 9 can be formed with high accuracy, and further, the desired AC voltage waveform can be applied to the electrodes 9 by suppressing a voltage drop. Further, while adhesion between the flow path forming member 4 and the substrate 1 is ensured, it is possible to manufacture an inkjet recording head provided with a micro-pump with high performance and high reliability, at low cost.

In this embodiment, when openings are formed in the insulating film 13 on the PAD electrodes 16, hollows 17 are formed at a time using wiring lines 10 as an etch stop layer, and stepped shapes of the electrodes 9 are formed by utilizing stepped shapes of the hollows 17, or by utilizing stepped shapes formed in the step of forming the supply ports 7. For example, in the step of forming the supply ports 7, when openings are formed in the substrate 1 by dry etching, hollows 17 can be formed at the same time, using wiring lines 10 as an etch stop layer in the surface of the insulating film 13, and stepped shapes of the electrodes 9 can be formed by utilizing stepped shapes of the hollows 17.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-186671, filed Sep. 27, 2017, which is hereby incorporated by reference herein in its entirety.

What is claimed is:

1. A method of manufacturing a liquid ejection head, comprising steps of:

forming, on a substrate, an energy generating element for ejecting a liquid;

forming an integrated circuit for driving the energy generating element on the substrate;

forming a supply port for the liquid such that the supply port penetrates through the substrate;

forming an electrode for generating a flow of the liquid; and forming a flow path forming member having an ejection orifice for ejecting the liquid therethrough such that a flow path for the liquid is formed between the substrate and the flow path forming member, wherein the step of forming the integrated circuit includes forming a plurality of wiring lines, each wiring line running in a direction intersecting the flow path such that a plurality of stepped shapes including the wiring lines are formed in a floor of the flow path at least between the supply port and the energy generating element, and wherein the step of forming the electrode includes forming a plurality of cranked electrodes, as corresponding respectively to the plurality of stepped shapes and extending from a floor surface of each stepped shape, via a lateral surface of the stepped shape extending in a direction intersecting a flow direction, to a top surface of the stepped shape.

2. The method according to claim 1, wherein the wiring line is composed of at least one selected from the group consisting of Al, Cu, W, Ta, Ir, Au, a compound thereof, and polysilicon.

3. The method according to claim 1, wherein the stepped shape is formed when an opening is formed in an insulating film provided on the substrate.

4. The method according to claim 3, wherein the stepped shape is formed when an opening is formed in a field oxide film.

5. The method according to claim 3, wherein the stepped shape is formed when a through hole is formed for connecting the wiring lines or connecting a wiring line and the substrate.

6. A liquid ejection head, comprising:

a substrate;

an energy generating element provided on the substrate for ejecting a liquid;

an integrated circuit provided on the substrate for driving the energy generating element;

a flow path forming member, which has an ejection orifice for ejecting the liquid therethrough and is provided such that a flow path for the liquid is formed between the substrate and the flow path forming member;

a supply port for the liquid, which communicates with the flow path and an external liquid supply source; and a plurality of electrodes for generating a flow of the liquid from the supply port toward the energy generating element, wherein the integrated circuit includes a plurality of wiring lines, each wiring line running in a direction intersecting the flow path, the wiring lines being arranged in a floor of the flow path at least between the supply port and the energy generating element to form stepped shapes projecting from the floor of the flow path, and wherein the plurality of electrodes are provided, each in a cranked shape, as extending from a floor surface of each stepped shape, via a lateral surface of the stepped shape extending in a direction intersecting a flow direction, to a top surface of the stepped shape.

7. The liquid ejection head according to claim 6, wherein the wiring lines are composed of at least one selected form the group consisting of Al, Cu, W, Ta, Ir, Au, a compound thereof, and polysilicon.

8. The liquid ejection head according to claim 6, wherein each of the wiring lines a power line or a signal line.

9. The liquid ejection head according to claim 6, wherein a stepped shape has a taper.

10. The liquid ejection head according to claim 6, wherein the integrated circuit includes an insulating film, and a stepped shape is formed by a hollow of the insulating film.

11. The liquid ejection head according to claim 10, wherein the insulating film is a passivation film, an SiO film, a BPSG film, an SOG film or a field oxide film.

12. The liquid ejection head according to claim 10, wherein a wiring line is arranged on a bottom surface of the hollow of the insulating film, and an electrode is in contact with the wiring line.

13. The liquid ejection head according to claim 12, wherein the wiring line is in the same layer as a PAD electrode arranged on the substrate.

14. The liquid ejection head according to claim 12, wherein an electric power for generating the flow of the liquid is supplied to the electrode through the wiring line.

15. The liquid ejection head according to claim 10, wherein an electrode is formed such that the electrode does not to come into contact with the flow path forming member.

16. The liquid ejection head according to claim 6, wherein the energy generating element is provided in a pressure chamber, and wherein the liquid in the pressure chamber circulates through an outside of the pressure chamber.

17. The liquid ejection head according to claim 6, wherein a second supply port is provided on a downstream side of the flow direction relative to the energy generating element, and wherein the wiring lines and the electrodes are provided also in the floor of the flow path between the energy generating element and the second supply port on the downstream side.

* * * * *